US010240592B2

(12) United States Patent
Khubani

(10) Patent No.: US 10,240,592 B2
(45) Date of Patent: Mar. 26, 2019

(54) PORTABLE AIR COMPRESSOR

(71) Applicant: Telebrands Corp., Fairfield, NJ (US)

(72) Inventor: Ajit Khubani, Saddle River, NJ (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 15/419,258

(22) Filed: Jan. 30, 2017

(65) Prior Publication Data

US 2018/0216612 A1 Aug. 2, 2018

(51) Int. Cl.

| | |
|---|---|
| ***F04B 35/04*** | (2006.01) |
| ***F04B 49/02*** | (2006.01) |
| ***F04B 37/12*** | (2006.01) |
| ***F04B 39/12*** | (2006.01) |
| ***F04B 49/10*** | (2006.01) |
| *F04B 39/00* | (2006.01) |
| *F04B 39/10* | (2006.01) |

(52) U.S. Cl.

CPC ..... *F04B 49/022* (2013.01); *F04B 35/04* (2013.01); *F04B 37/12* (2013.01); *F04B 39/121* (2013.01); *F04B 49/10* (2013.01); *F04B 39/0005* (2013.01); *F04B 39/10* (2013.01); *F04B 2207/042* (2013.01); *F04B 2207/702* (2013.01)

(58) Field of Classification Search

CPC ..... F04B 49/022; F04B 49/10; F04B 35/04; F04B 37/12; F04B 39/10; F04B 39/121; F04B 2207/042; F04B 2207/702; B25F 5/029; B25F 5/027; B25B 21/00; B25C 1/08; B25G 1/08

USPC ..... 439/501; 417/234; 81/52, 177.4, 490

See application file for complete search history.

(56) References Cited

U.S. PATENT DOCUMENTS

| | | | | |
|---|---|---|---|---|
| 4,080,105 | A * | 3/1978 | Connell | F04B 35/04 137/224 |
| 4,789,310 | A * | 12/1988 | Hung | A47L 5/24 15/339 |
| 5,228,523 | A | 7/1993 | Rahm | |
| 5,923,146 | A * | 7/1999 | Martensson | B60L 11/1818 320/111 |
| 6,491,113 | B1 | 12/2002 | Heinrichs | |
| 7,461,703 | B2 | 12/2008 | Cheng | |

FOREIGN PATENT DOCUMENTS

| | | | | |
|---|---|---|---|---|
| EP | 0079101 | A2 * | 5/1983 | A45D 20/10 |

OTHER PUBLICATIONS

Machine Translation of EP 0079101 A2, retrieved from worldwide.espacenet.com/advancedSearch?locale=en_EP.*

* cited by examiner

*Primary Examiner* — Philip Stimpert
(74) *Attorney, Agent, or Firm* — Cooper & Dunham LLP

(57) ABSTRACT

A portable air compressor including a housing, an air compressing assembly within the housing, the air compressing assembly including a switch, a motor, a gear assembly, and a piston, and a storage unit integrated as part of the housing and retaining a power cord and an adapter.

18 Claims, 6 Drawing Sheets

PORTABLE AIR COMPRESSOR

BACKGROUND

Electric air compressors can be convenient and can allow users to avoid using manual pumps. Electric air compressor can be used to inflate tires (e.g., automobile, bicycle, etc.), inflatable toys, inflatable mattresses, etc. Despite the convenience of electric air compressors, many electric air compressors can be difficult, burdensome, and/or bulky to transport and use. For example, electric air compressors may require different adapters, extensions, etc. which may be difficult to manage and easy to misplace.

SUMMARY

Embodiments of the present invention can provide a portable air compressor including a housing, an air compressing assembly disposed within the housing, the air compressing assembly including a switch, a motor, a gear assembly, a piston, and a storage unit integrated as part of the housing and configured to retain at least one of a power cord and an adapter.

According to certain embodiments, the storage unit may can include a cover pivotally coupled to the housing via a hinge. The storage unit may be disposed on a power portion of the housing. Further, the housing can be in the shape of a pistol.

According to certain embodiments, the piston may include a piston housing. The piston housing may include an air valve with includes a spring and plug. Additionally, the portable air pressure compressor may include an air pressure sensor. The air pressure sensor can be configured to accept a pressure threshold and can include an automatic shut-off feature to shut the portable air compressor OFF when a pressure of an object being inflated by the portable air compressor reaches the pressure threshold.

According to certain embodiments, the portable air compressor may include a light source. Further, the portable air compressor may include a display, a trigger coupled to the switch, and a safety switch. According to certain embodiments, the gear assembly may include a primary gear and a secondary gear.

Another embodiment of the present invention can provide a portable air compressor including a housing, an air compressing assembly disposed within the housing, the air compressing assembly including a switch, a motor, a gear assembly, a piston, a storage unit integrated in a lower portion of the housing and configured to retain at least one of a power cord and an adapter, and an air pressure sensor configured to accept a pressure threshold and includes an automatic shut-off feature to shut the portable air compressor OFF when a pressure of an object being inflated by the portable air compressor reaches the pressure threshold.

According to certain embodiments, the storage unit may can include a cover pivotally coupled to the housing via a hinge.

According to certain embodiments, the piston may include a piston housing. The piston housing may include an air valve with includes a spring and plug.

BRIEF DESCRIPTION OF THE DRAWINGS

The features and advantages of the present invention can be more readily understood from the following detailed description with reference to the accompanying drawings, wherein.

DETAILED DESCRIPTION

Figure 1:
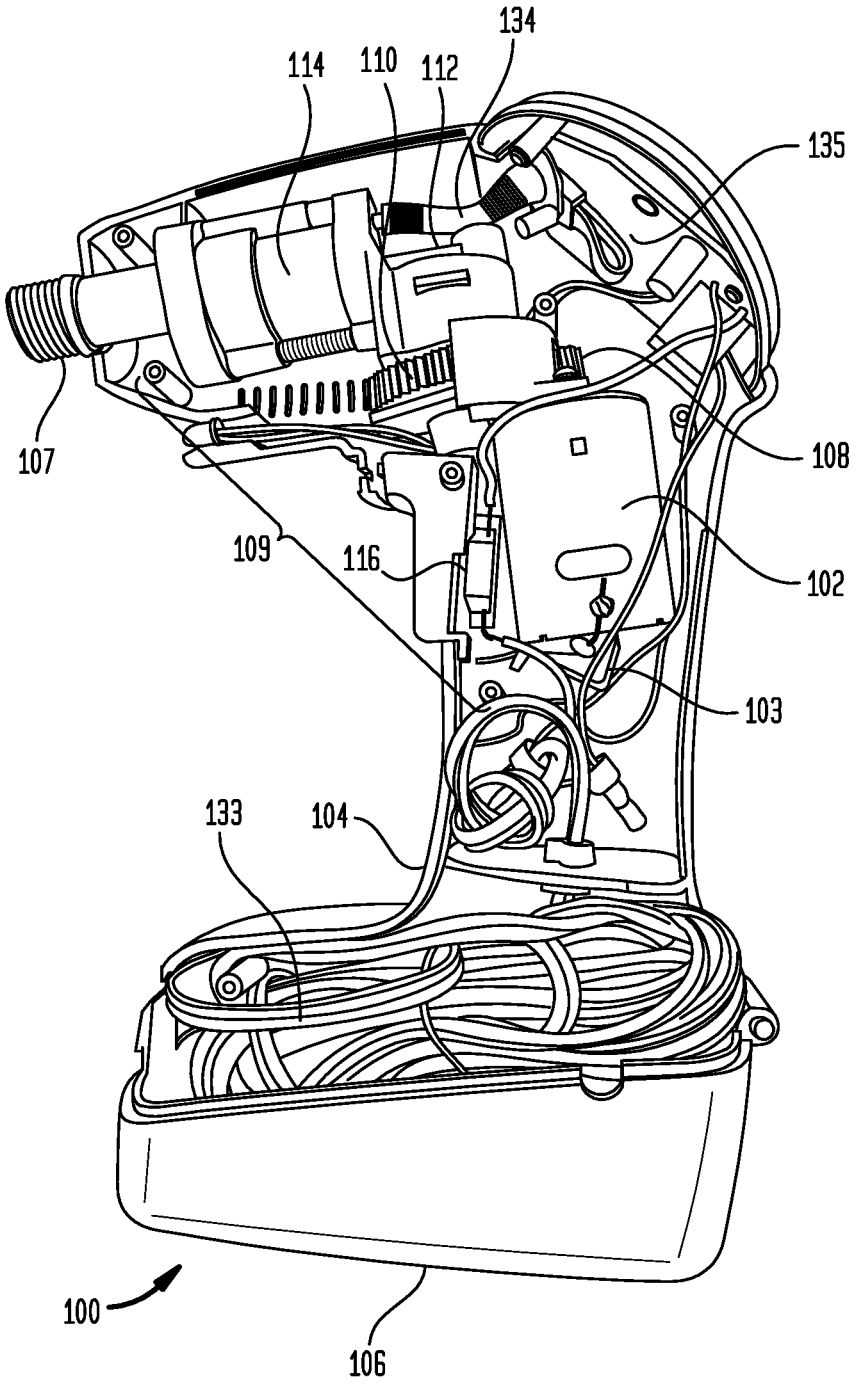
FIG. 1 is a diagram of an exemplary portable air compressor according to one embodiment of the present invention.

Exemplary embodiments of the present invention can provide a novel portable electric air compressor. Exemplary portable air compressor 100 is shown in the FIGS. 1-6. Exemplary portable air compressor 100 can facilitate providing compressed air to an object to be inflated. For example, the exemplary air compressor 100 can easily be used to inflate any object, such as tires, inflatable toys, inflatable bed, and the like.

As shown in FIGS. 1-6, exemplary portable air compressor 100 can include housing 104, air compressing assembly 109, switch 116, output 107, nozzle 105 and storage unit 106. Air compressing assembly 109 can be operated via switch 116 to provide compressed air to an object requiring inflation via output 107. Further, storage unit 106 can be integrated into housing 104 and can store accessories, adapters, power cord, and the like. Housing 104 may be shaped to allow convenient operation, storage, and portability of air compressor 100. Housing 104 can house air compressing assembly 109, switch 116, and output 107. Nozzle 105 can facilitate the attachment of various extensions and adapters to output 107.

Figure 2:
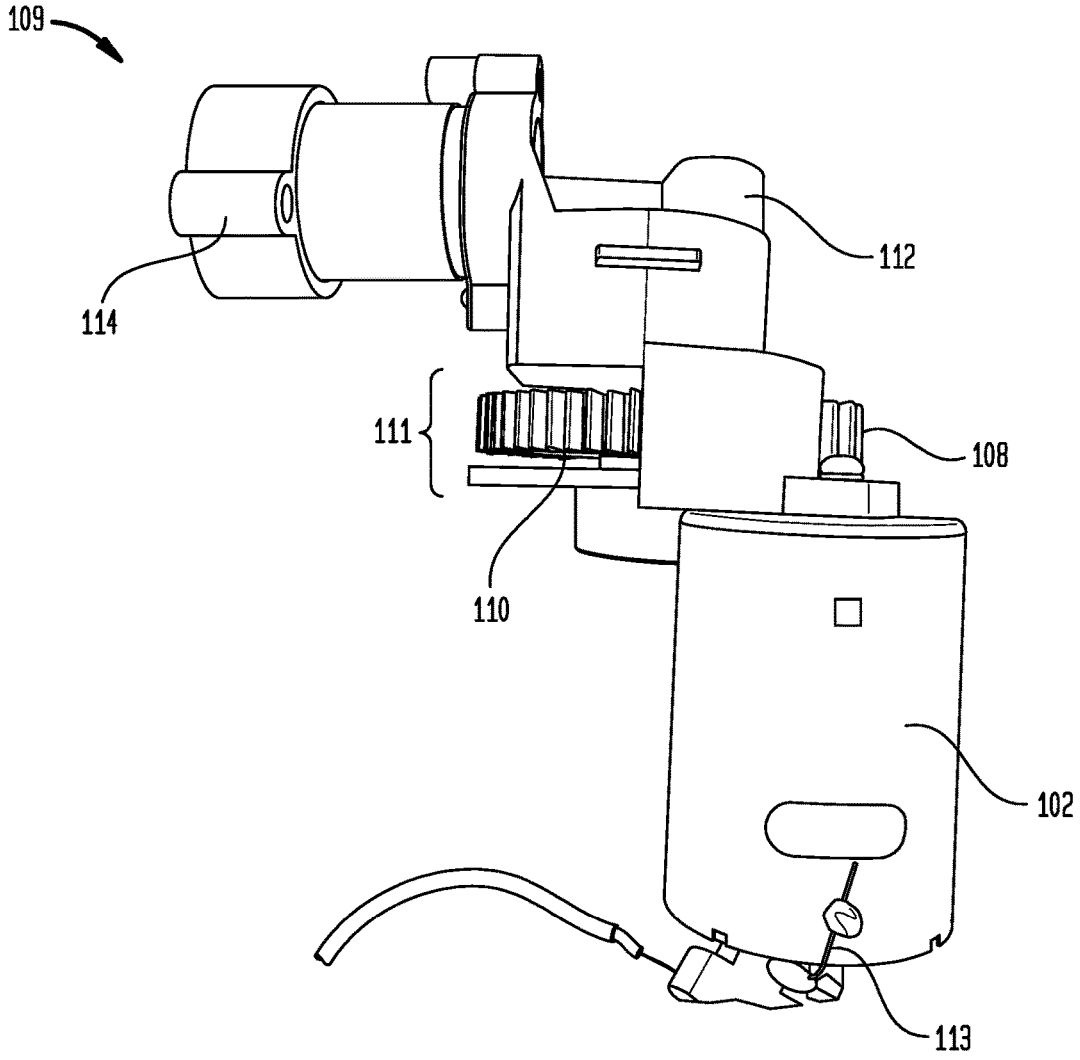
FIG. 2 is a diagram of an exemplary air compressing assembly according to one embodiment of the present invention.
Figure 3:
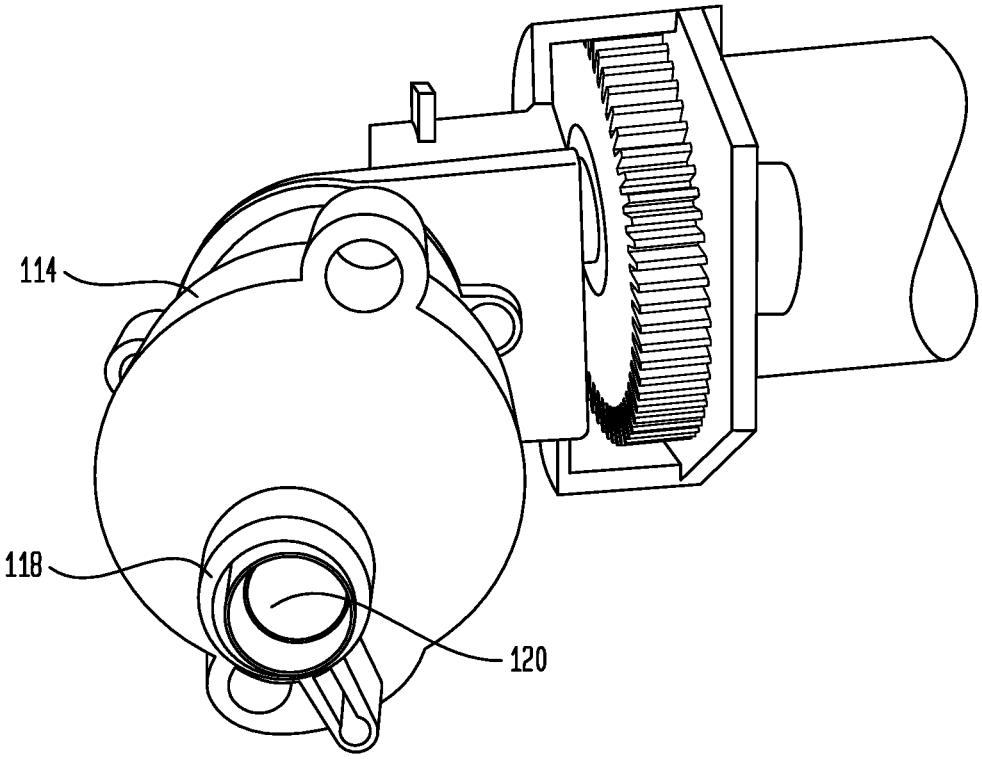
FIG. 3 is a diagram of an exemplary air compressing assembly according to one embodiment of the present invention.

As shown in FIGS. 1-3, air compressing assembly 109 may be disposed within housing 104 and may include power supply 103, motor 102, gear assembly 111, piston 112, piston housing 114, and air valve 120. As shown in FIGS. 1 and 2, motor 102 may be operatively coupled to piston 112 via gear assembly 111 to drive piston 112 in producing the compressed air. For example, motor 102 may be powered by power supply 103 to drive piston 114 via gear assembly 111, reducing the volume of the air to produce the compressed air. As shown in the Figures, piston 112 may be disposed within piston housing 114. Air compressing assembly 109 can further include various valves, which can be configured to produce the compressed air in cooperation with motor 102 and piston 112. For example, air compressing assembly 109 may include air valve 120 to allow for the release of compressed air within piston housing 114.

According to embodiments of the present invention, motor 102 may be an electric motor, (e.g., DC motor, AC motor, etc.). However, motor 102 may be any type of motor. Motor 102 can be selectively operated and/or controlled via switch 116. For example, activation of switch 116 may cause motor 102 to drive gear assembly 111 and ultimately piston 112. Motor may be operatively coupled to gear assembly 111, which can be coupled to piston 112. Gear assembly 111 may include one or more gears, such as primary gear 108 and secondary gear 110. Although FIGS. 1 and 2 show gear assembly 111 including two gears, primary gear 108 and secondary gear 110, gear assembly 111 may include any number of gears such as one, three, four, five or any other number of gears desired. In one embodiment of the present invention, the diameter of secondary gear 110 may be greater than the diameter of primary gear 108. However, in another embodiment, the diameter of secondary gear 110 may be less than or the same diameter as primary gear 108.

Specifically, motor 102 may be coupled to primary gear 108 of gear assembly 111 causing primary gear 108 to rotate when driven by motor 102. Primary gear 108 may be further rotationally coupled to secondary gear 110, which may be coupled to piston 112. When primary gear 108 rotates, secondary gear 110 may also rotate due to the teeth of primary gear 108 being interconnected with the teeth of secondary gear 110. Rotation of secondary gear 110 may cause piston 112 to linearly reciprocate within piston housing 114.

Piston housing 114 may be coupled to output 107 and may include opening 118 and air valve 120. Air valve 120 may be disposed within opening 118 of piston housing 114 and may allow for the release of compressed air generated by the reciprocating movement of piston 112 within piston housing 114. The compressed air may exit exemplary portable air compressor 100 through air valve 120, out of output 107. Air valve 120 may include, for example, a spring and a plug where the spring may be coupled to the plug to bias the plug to seal opening 118. Air may only exit opening 118 when pressure is generated by piston 112 compressing air within piston housing 114, opening air valve 120. When air valve 120 is open, air may be able to exit piston housing 114 through opening 118 and out of exemplary portable air compressor 100 via output 107.

According to certain embodiments of the present invention, piston 112 may be driven by motor 102 to have a linear reciprocating motion. For example, piston 112 may move towards and away from opening 118 of piston housing 114 as secondary gear 110 rotates such that the rotational motion of secondary gear 110 can be translated into linear motion of piston 112. Accordingly, as piston 112 is driven toward opening 118, it compresses the air within piston housing 114, and as piston 112 is moved away from opening 118, air enters piston housing 114. Further, air valve 120 cooperatively acts with piston 112 to produce the compressed air. For example, the pressure against air valve 120 may cause air valve 120 to open, unsealing opening 118, thereby allowing the compressed air to exit opening 118

In practice, motor 102 may be coupled to power supply 103. According to certain embodiments of the present invention, power supply 103 may provide power to air compressing assembly 109. For example, power supply 103 may power air compressing assembly 109 via an internal battery, and/or obtain power from an external power supply (e.g., 12V DC, 110V AC, etc.) via power cord 133. For example, air compressor 100 can include a 12V DC connector that can be used with a cigarette lighter/12 V outlet receptacle of an automobile. However, air compressing assembly 109 may be powered by any type of power supply capable of providing the necessary and desired power. Power supply 103 may be coupled to switch 116. Switch 116 may be a push button, flip switch or any other mechanism capable of controlling power to motor 102. In practice, a user may engage switch 116 to supply power from power supply 103 to motor 102. When motor 102 receives power, motor 102 can drive piston 112 via gear assembly 111.

In one embodiment of the present invention, housing 104 may be in the shape of a gun/pistol. However, housing 104 may be formed in any shape that can provide easy and convenient operation, storage, and transportation of air compressor 100. Housing 104 may be in any shape that may be able to house air compressing assembly 109 and allow for convenient and easy operation of air compressor 100. According to certain embodiments, housing 104 may be made out of plastic. Housing 104 may be a single integral piece or a multi-piece assembly. For example, housing 104 can include two halves that may be coupled together. Alternatively, housing 104 may include multiple pieces such as three, four, five or any number of pieces desired, that can be coupled together to form housing 104. Other than plastic, housing 104 may be made out of any suitable material, such as silicone, metal, composites, or any other type of material.

Figure 4:
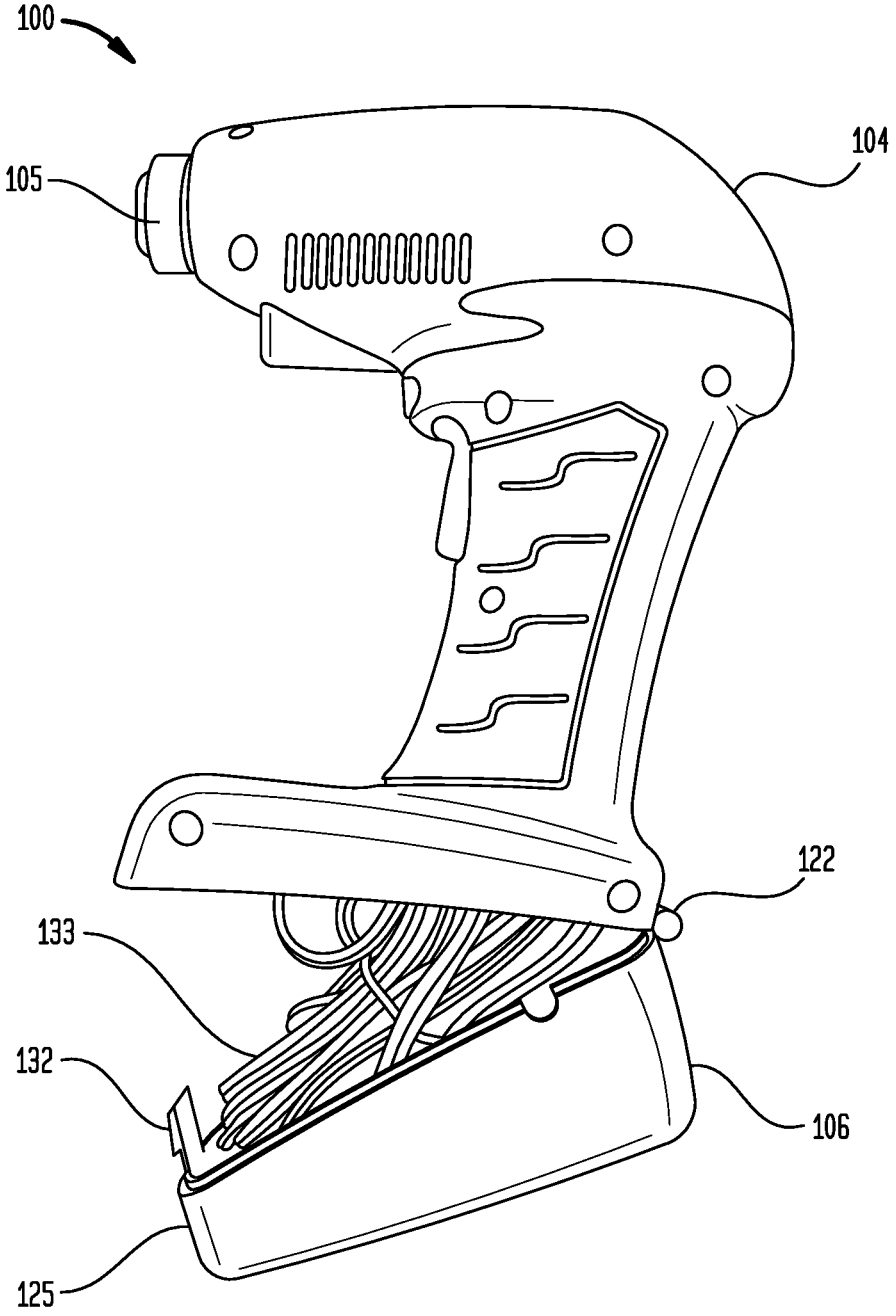
FIG. 4 is a diagram of an exemplary portable air compressor according to one embodiment of the present invention
Figure 5:
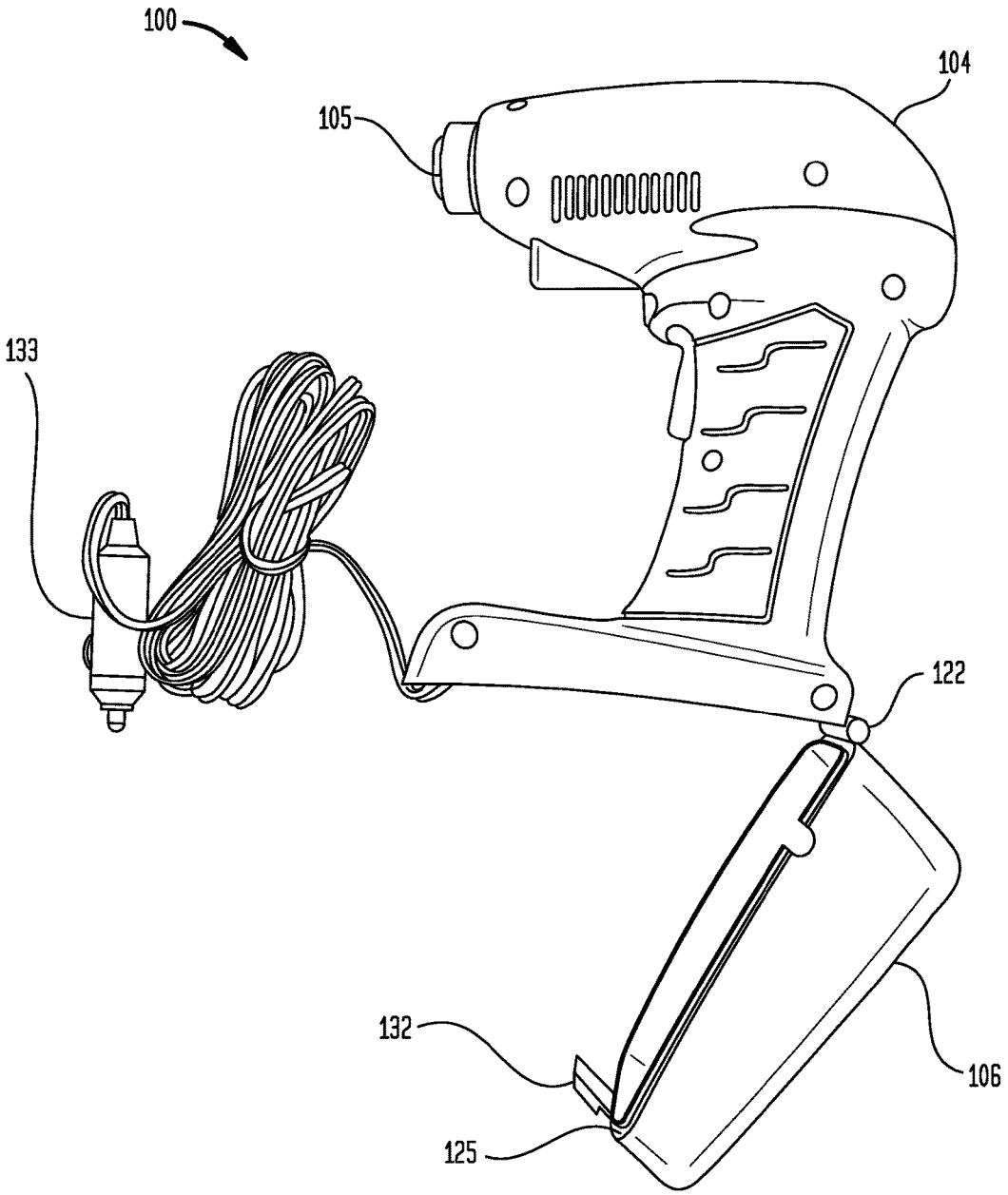
FIG. 5 is a diagram of an exemplary portable air compressor according to one embodiment of the present invention.
Figure 6:
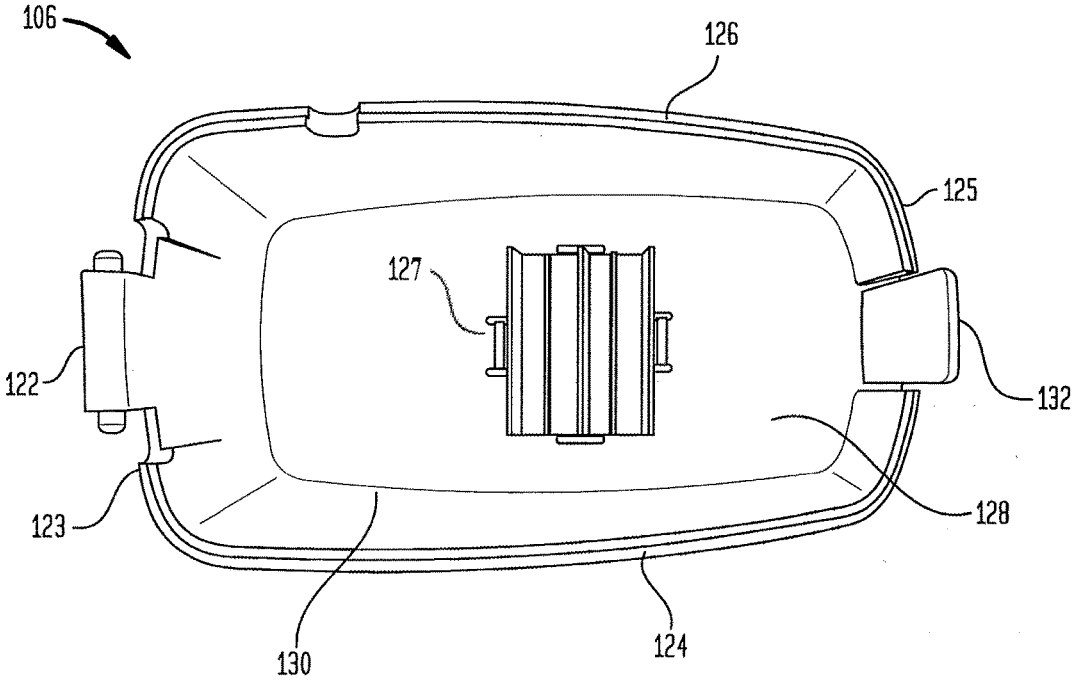
FIG. 6 is a diagram of an exemplary storage unit according to one embodiment of the present invention.

As shown in FIGS. 4-6, exemplary portable air compressor 100 can include storage unit 106. Storage unit 106 is preferably configured to hold and store accessories, attachments, and/or a power cord. Storage unit 106 may include hinge 122, side walls 124, 126, front wall 125, back wall 123 and recessed portion 130 and can be releasably coupled to housing 104. In one embodiment of the present invention, hinge 122 be located along back wall 123 and can allow storage unit 106 to be pivotally coupled to housing 104 allowing storage unit 106 to pivotally rotate away from housing 104. Hinge 122 may allow storage unit 106 to be in an open position or a closed position. In one embodiment of the present invention, front wall 125, back wall 123, side walls 124, 126 and bottom wall 128 may make up recessed portion 130 of storage unit 106. Storage unit 106 may further include a locking mechanism 132 that can releasably secure storage unit 106 in a closed position. In one embodiment of the present invention, securing element 132 may extend from front wall 125. However, locking mechanism 132 may extend from any wall of storage unit 106, such as side walls 124, 126 or back wall 123. Locking mechanism 132 may be opposite from hinge 122. However, in another embodiment of the present invention, locking mechanism 132 may be adjacent to hinge 122. For example, locking mechanism 132 may be on side wall 124, 126. Locking mechanism 132 may be used to further couple storage unit 106 to housing 104 when storage unit 106 is in a closed position.

In certain embodiments of the present invention, power cord 133 may be stored within storage unit 106. Power cord 133 may be coupled to motor 102 via power supply 103 and may be disposed within recessed portion 130 of storage unit 106. Further, one of walls 123, 124, 125, or 126 may include a cutout through which power cord 133 can extend in the event that storage unit 106 is closed and power cord 133 is needed to power exemplary portable air compressor 100. In one embodiment of the present invention, various extensions for exemplary portable air compressor 100 may be disposed within recessed portion 130 of storage unit 106. For example, various needles and other attachments for exemplary portable air compressor 100 may be disposed within the recessed portion of storage unit 106. Various extensions and adapters may also be coupled to bottom wall 128.

In one embodiment of the present invention, exemplary portable air compressor 100 may include extensions and/or adapters. For example, exemplary portable air compressor 100 may include an adapter for inflating athletic equipment such as footballs, basketballs, soccer balls, etc. Exemplary portable air compressor 100 may include an extension for coupling exemplary portable air compressor 100 to a tire. The tire may be for an automobile, a bicycle, a unicycle or any other type of tire. Further, exemplary portable air compressor 100 may include any other type of adapter or extension. In one embodiment of the present invention, the extensions and adapters may be coupled to output 107. Storage unit 106 may include fastener, recesses, retaining elements 127, etc. that may be molded into the bottom or walls 123, 124, 125, or 126 to secure the various attachments, extensions and adapters when not in use. Nozzle 105 may be used to secure the extensions and adapters to output 107.

In one embodiment of the present invention, housing 104 may include air pressure sensor 134. Air pressure sensor 134 may be coupled to piston housing 114 and may detect the air pressure within piston housing 114. In one embodiment of the present invention air pressure sensor 134 may include display 135. Display 135 may display the air pressure within piston housing 114. Display 135 may be disposed within housing 104. However, display 135 may be along housing 104 or outside housing 104. Display 135 may include user inputs which may allow the user to set air pressures or alarms for defined air pressures.

In one embodiment of the present invention, exemplary portable air compressor 100 may include an automatic shut-off feature. For example, when the air pressure sensor 134 records a specific pre-determined pressure, exemplary portable air compressor 100 may shut-off, preventing more air from being expelled by exemplary portable air compressor 100. For example, a user may input on display 135 a specific air pressure that when registered by air pressure sensor 134, may cause exemplary portable air compressor 100 to shut-off. In one embodiment of the present invention, air pressure sensor 134 and display 135 may be connected to power supply 103. When air pressure sensor 134 determines a specific air pressure inputted by user on display 135, air pressure sensor 134 may interrupt the connection between power supply 103 and motor 102, stopping motor 102.

In one embodiment of the present invention, switch 116 may be coupled to a trigger. The trigger may be disposed along housing 104. In another embodiment of the present invention, the trigger may be accessible by the hand or finger of the user. In yet another embodiment of the present invention, depression of the trigger may complete the circuit between motor 102 and power supply 103 which may activate motor 102.

In one embodiment of the present invention, exemplary portable air compressor 100 may include a safety switch. The safety switch may be disposed on housing 104 of exemplary portable air compressor 100. The safety switch may lock the trigger. Locking of the trigger may prevent depression of the trigger, which prevents activation of switch 116. Preventing activation of switch 116 may prevent completion of the circuit between motor 102 and power supply 103. The safety switch may be used to prevent accidental depression of switch 116.

In one embodiment of the present invention, exemplary portable air compressor 100 may include an air tank. The air tank may be coupled to air compressing assembly 109 and may be disposed within housing 104. In another embodiment, the air tank may be outside housing 104 and may be coupled to air compressing assembly 109 via a tube or conduit.

In one embodiment of the present invention, exemplary portable air compressor 100 may include a light source. The light source may be any type of element capable of producing light. For example, the light source may be an LED, a lamp, a bulb or any other element capable of producing light. In another embodiment of the present invention, the light source may be disposed within housing 104. In yet another embodiment of the present invention, the light source may be detachable from exemplary portable air compressor 100. The light source may have its own power source. In yet another embodiment of the present invention, the light source may be coupled to the same power source as motor 102.

The embodiments and examples shown above are illustrative, and many variations can be introduced to them without departing from the spirit of the disclosure. For example, elements and/or features of different illustrative and exemplary embodiments herein may be combined with each other and/or substituted with each other within the scope of the disclosure. For a better understanding of the disclosure, reference should be had to any accompanying drawings and descriptive matter in which there is illustrated exemplary embodiments of the present invention.

The invention claimed is:

1. A portable air compressor comprising:

a pistol-shaped housing having a handle portion;

an air compressing assembly disposed within the housing, the air compressing assembly including a switch, a motor, a gear assembly, and a piston; and a storage unit integrated into the handle portion of the housing and configured to retain at least one of a power cord and an adapter within the storage unit, wherein the storage unit includes a cover having a power cord pass-through and is pivotally coupled to the handle portion of the housing to pivot between an open position and a closed position.

2. The air compressing assembly of claim 1, wherein the piston includes a piston housing.

3. The air compressing assembly of claim 2, wherein the piston housing includes an air valve.

4. The portable air compressor of claim 3, wherein the air valve includes a spring and a plug.

5. The portable air compressor of claim 1, further comprising an air pressure sensor.

6. The portable air compressor of claim 5, wherein the air pressure sensor is configured to accept a pressure threshold and includes an automatic shut-off feature to shut the portable air compressor OFF when a pressure of an object being inflated by the portable air compressor reaches the pressure threshold.

7. The portable air compressor of claim 1, wherein the portable air compressor includes a light source.

8. The portable air compressor of claim 1, wherein the portable air compressor includes a display.

9. The portable air compressor of claim 1, wherein the portable air compressor includes a trigger coupled to the switch.

10. The portable air compressor of claim 1, wherein gear assembly includes a primary gear and a secondary gear.

11. The portable air compressor of claim 1, wherein the portable air compressor includes a safety switch.

12. The portable air compressor of claim 1, wherein the storage unit includes at least one retaining element configured to secure the adapter within an interior of the storage unit.

13. The portable air compressor of claim 1, further comprising a power cord, the power cord extending through a divider adjacent to the storage unit, such that a first portion of the power cord is disposed within the housing coupled to the air compressing assembly and a second portion is disposed within the storage unit.

14. A portable air compressor comprising:

a pistol-shaped housing having a handle portion;

an air compressing assembly disposed within the housing, the air compressing assembly including a switch, a motor, a gear assembly, and a piston;

a storage unit integrated into the handle portion of the housing and configured to retain at least one of a power cord and an adapter within the storage unit, wherein the storage unit includes a cover having a power cord pass-through and is pivotally coupled to the handle portion of the housing to pivot between an open position and a closed position; and an air pressure sensor configured to accept a pressure threshold, the air pressure sensor including an automatic shut-off feature to shut the portable air compressor OFF when a pressure of an object being inflated by the portable air compressor reaches the pressure threshold.

15. The air compressing assembly of claim 14, wherein the piston includes a piston housing.

16. The air compressing assembly of claim 15, wherein the piston housing includes an air valve.

17. The portable air compressor of claim 16, wherein the air valve includes a spring and a plug.

18. The portable air compressor of claim 14, further comprising a power cord, the power cord extending through a divider adjacent to the storage unit, such that a first portion of the power cord is disposed within the housing coupled to the air compressing assembly and a second portion is disposed within the storage unit.

* * * * *